US010597227B2

(12) United States Patent
Matuschek et al.

(10) Patent No.: US 10,597,227 B2
(45) Date of Patent: Mar. 24, 2020

(54) DUSTBIN LOCK ASSEMBLY

(71) Applicant: Franzen Canada Corp., Kitchener (CA)

(72) Inventors: Manfred Ernst Matuschek, Solingen (DE); Tobias Ackermann, Solingen (DE)

(73) Assignee: Franzen Canada Corp., Kitchener (CA)

( * ) Notice: Subject to any disclaimer, the term of this patent is extended or adjusted under 35 U.S.C. 154(b) by 310 days.

(21) Appl. No.: 15/170,307

(22) Filed: Jun. 1, 2016

(65) Prior Publication Data

US 2017/0291764 A1 Oct. 12, 2017

Related U.S. Application Data

(60) Provisional application No. 62/319,603, filed on Apr. 7, 2016.

(51) Int. Cl.
*B65F 1/16* (2006.01)
*E05B 65/00* (2006.01)

(52) U.S. Cl.
CPC ..... *B65F 1/1615* (2013.01); *B65F 1/1623* (2013.01); *B65F 1/1646* (2013.01); *E05B 65/00* (2013.01)

(58) Field of Classification Search
CPC .... B65F 1/1615; B65F 1/1623; B65F 1/1646; Y10T 292/0862; Y10T 292/0911; Y10T 292/0926; Y10T 292/0932; Y10T 292/0947; Y10T 292/0949; Y10T 292/1043; Y10T 292/1056;
(Continued)

(56) References Cited

U.S. PATENT DOCUMENTS 2,659,621 A * 11/1953 Jacobson ..... E05B 65/0042 292/129
6,454,320 B1 * 9/2002 Weinerman ..... E05B 13/105 290/53

(Continued)

FOREIGN PATENT DOCUMENTS

CA 2820990 A1 * 1/2014 ..... B65F 1/1615
DE 19708193 A1 * 9/1997 ..... B65F 1/1615
DE 102007039351 A1 * 11/2008 ..... B65F 1/1615

OTHER PUBLICATIONS

Computer Generated Translation for DE 102007039351, Generated on Apr. 15, 2019, https://worldwide.espacenet.com/ (Year: 2019).*

*Primary Examiner* — Alyson M Merlino

(57) ABSTRACT

The invention provides a covered dustbin or covered container. In particular, the invention relates to a lock assembly for dustbins and covered containers. A lower half of the lock is mounted to the inside wall of the dustbin and an underlid half is mounted to the underside of a lid that is hinged to a location adjacent the upper rim of the dustbin. A pair of interlocking engagement members is provided to releasably secure the lid to the dustbin. The lower half and the underlid half each include one interlocking engagement member, such as a hook and a strike. A rocker, when actuated, urges the interlocking engagement members into a disengaged position, for example to disengage the hook from the strike. A user can use a handle provided on the lid to press down the rocker to disengage the lock and lift the lid in a one-hand operation.

18 Claims, 6 Drawing Sheets

(58) Field of Classification Search
CPC ..... Y10T 292/1059; Y10T 292/1077; Y10T 292/108; Y10T 292/20; Y10T 292/202; Y10T 292/225; Y10T 292/696; Y10T 292/702; B65D 45/00; B65D 45/02; B65D 45/025; B65D 45/16; B65D 45/22; B65D 43/22; B65D 43/16; B65D 43/163; B65D 43/164; F16J 13/00; E02F 29/1427; E05B 65/00; Y10S 292/11
USPC ..... 220/326, 324, 318, 315, 827, 810
See application file for complete search history.

(56) References Cited

U.S. PATENT DOCUMENTS

| | | | | |
|---|---|---|---|---|
| 2007/0084865 | A1* | 4/2007 | Moore | B65F 1/1615 220/326 |
| 2016/0060898 | A1* | 3/2016 | Michael | B65F 1/1615 292/200 |
| 2016/0159569 | A1* | 6/2016 | Reeb | B65F 1/1615 220/315 |
| 2016/0200509 | A1* | 7/2016 | Matuschek | B65F 1/1615 292/242 |
| 2017/0043950 | A1* | 2/2017 | Reeb | B65F 1/1615 |

* cited by examiner

DUSTBIN LOCK ASSEMBLY

FIELD OF INVENTION

The invention relates generally to the field of dustbins and covered containers. In particular, the invention relates to a lock assembly or safety lock for dustbins and covered containers.

BACKGROUND OF INVENTION

It is known to provide lid for covering the opening of a container, such as a garbage can or dustbin. In a normal storage position, the container stands upright, and the lid naturally falls down by force of gravity, thus covering the top opening. However, for lids not of significant weight, an animal may be able to lift a lid and reach for contents stored in the container. Increasing the weight would be wasteful and not effective against tampering by all animals. Additionally, when the container tips over or is knocked down, a lid may also become open due to gravity. In strong wind, lids made of lightweight materials such as plastic also may be blown open.

It is desirable to provide locks or latches for such covered containers to prevent animal tampering and to prevent accidental opening due to strong wind or tipping over of the container. There have been proposals for providing a lock or safety latch for such covered containers. For example, EP2,148,828B1, "Dustbin Lock", discloses a dustbin lock for releaseably securing a lid to a dustbin. In the locking position, the lid is prevented from being lifted to uncover the opening. However, the proposed dustbin lock does not permit a one-hand operation to release the lock and to lift the lid at the same time, which might be viewed as inconvenient for some users. There also have been proposals of combining a handle with a slider. However, a user will need to lift the handle and also push the slider against a biasing force, required for the lock, in order to release the lock and to lift the lid, which could pose a challenge to some users.

There is therefore a need for an improved lock assembly or safety lock for dustbins and covered containers as compared to the existing art. It is an object of the present invention to mitigate or obviate at least one of the above mentioned disadvantages.

SUMMARY OF INVENTION

The present invention is directed to a lock assembly for dustbins and covered containers and also directed to dustbins and covered containers equipped with such a lock assembly. A broad aspect of the present invention involves an easy to operate lock assembly. In one embodiment, the present invention provides a lock assembly that has a lower half mounted to an inside wall of a dustbin, an underlid half mounted to the underside of a lid for the dustbin, the lower half and the underlid half each having engagement member forming an interlocking assembly for releasably securing the lid to the dustbin, and an actuator with a handle, mounted to the lid, for releasing the lock and lifting the lid. In another embodiment, the present invention provides a covered container having such a lock assembly installed thereon.

In a first aspect of the invention, there is provided a lock for a container lid sized to cover a top opening of a container. The lock has a lock casing for attaching to the container, a strike supported on the lock casing, a hook assembly for attaching to the lid, the hook assembly having a hook for engaging the strike, a biasing member urging the hook and the strike to engage with each other to keep the lid in a closed position covering the opening, a rocker pivotally attached to the hook assembly at a pivot point, the rocker having a top tab extending upwardly and a release arm extending downwardly, both from the pivot point, wherein pressing down the top tab moves the release arm to disengage the hook from the strike so that the lid can be lifted to uncover the opening, and an actuator for a user to press down the top tab and to lift the lid to uncover the opening.

According to a feature of this aspect of the invention, the strike has facing support plates formed on a base, and a strike pin supported at both ends of the pin by the facing support plates, the hook engages with the strike pin when in the engaged position, and tilting the base moves the strike pin towards the disengaged position, wherein the hook has an upper edge for engaging the strike pin in the engaged position and a curved lower edge that pushes the strike pin to tilt the base against its biasing to disengage the strike from the hook until the upper edge moves past the strike pin.

Optionally, the actuator has a handle for rotatably mounting to the lid, and an control disk fixedly attached to the handle for turning together with the handle, and the control disk has a first angular location and a second angular location separated by a non-zero angle. When the handle is rotated to align the first angular location with the top tab, the control disk makes contact with and presses down the top tab to disengage the hook from the strike, and when the handle is rotated to align the second angular location with the top tab, the control disk makes no contact with the top tab or does not press the top tab down sufficiently to disengage the hook from the strike, thus leaving the lock in the engaged position.

According to another feature, the actuator has a handle for mounting slidably to the lid, and an actuation block fixedly attached to the handle for sliding together with the handle, and the actuation block has a first block position and a second block position separated by a non-zero distance. When the handle is moved to align the first block position with the top tab, the actuation block presses down the top tab to disengage the hook from the strike, and when the handle is moved to align the second block position with the top tab, the actuation block makes no contact with the top tab or does not press the top tab down sufficiently to disengage the hook from the strike, thus leaving the lock in the engaged position.

According to yet another feature, the lock further comprises a second biasing member, wherein the release arm is movable between an extended position, at which position, the release arm pushes at least one of the hook and the strike to disengage the hook from the strike, and a retracted position, at which position, the release arm does not disengage the hook from the strike.

Optionally, the hook is fixedly located on the hook assembly, e.g., integrally formed with the hook assembly, and the release arm pushes the strike away from the hook against the biasing to disengage the hook from the strike when the top tab is pressed down.

As a further feature, the lock includes a second biasing member, the second biasing member urging the release arm away from the strike. The release arm pushes the strike away from the hook assembly against the biasing of the first biasing member and the second biasing member to disengage the hook from the strike when the top tab is pressed down.

According to another aspect of the invention, there is provided a container body having a top opening for receiving objects therein, a lid joined to the container body at a hinged location adjacent the top opening, and a lock as described above, wherein the lock casing of the lock is attached to the container at a latch location adjacent the top opening spaced from the hinged location, the hook assembly of the lock is attached to the lid at a location so that the hook and the strike engage with each other to secure the lid in a closed position to cover the top opening, and the actuator of the lock is attached to the lid for a user to disengage the hook from the strike and lift the lid to uncover the top opening.

In other aspects the invention provides various combinations and subsets of the aspects described above.

BRIEF DESCRIPTION OF DRAWINGS

For the purposes of description, but not of limitation, the foregoing and other aspects of the invention are explained in greater detail with reference to the accompanying drawings, in which.

DETAILED DESCRIPTION OF EMBODIMENTS

Figure 1:
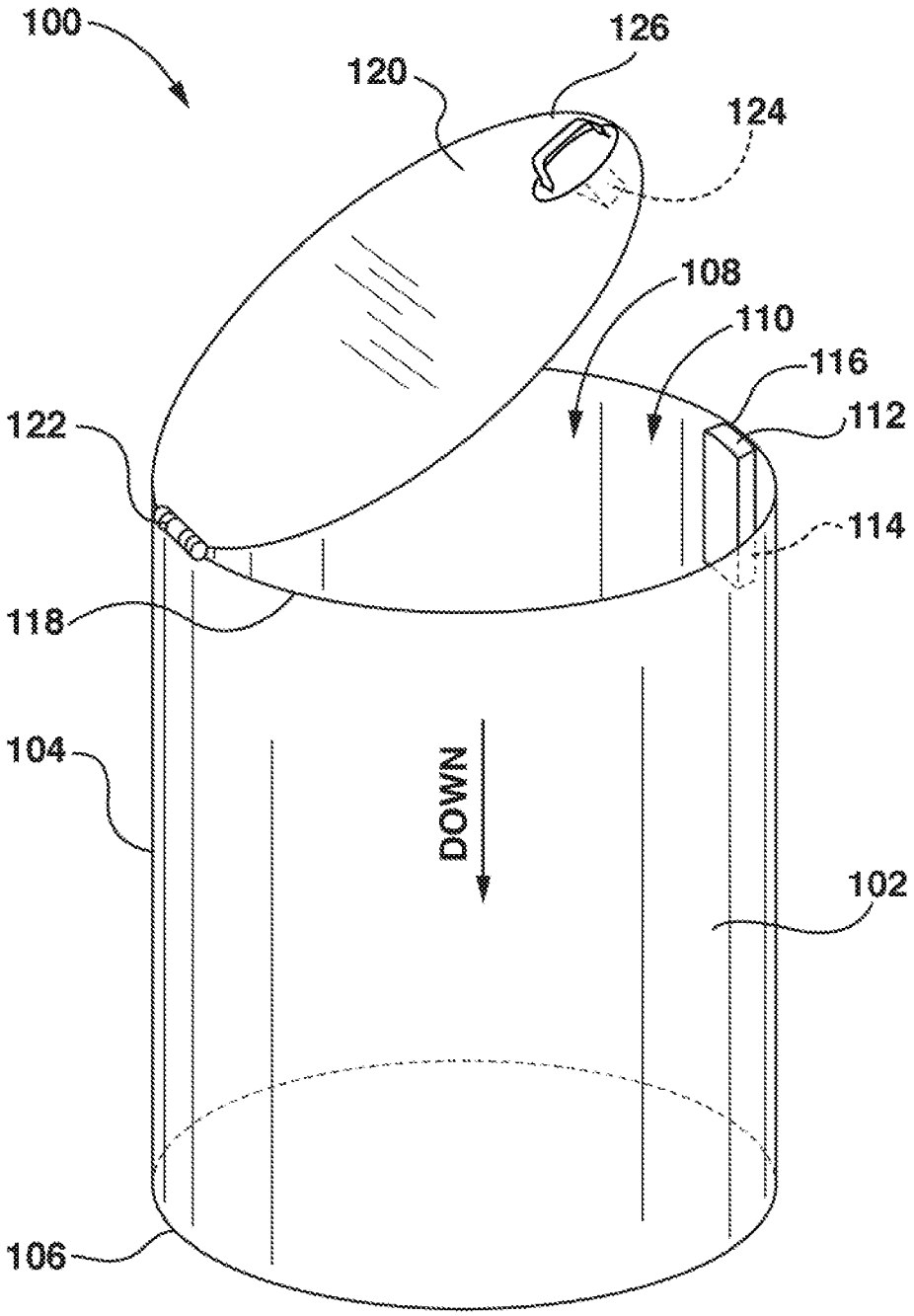
FIG. 1 illustrates a covered container having a lock assembly with its lower half and its underlid half mounted to a dustbin and its lid, respectively.

The description which follows and the embodiments described therein are provided by way of illustration of an example, or examples, of particular embodiments of the principles of the present invention. These examples are provided for the purposes of explanation, and not limitation, of those principles and of the invention. In the description which follows, like parts are marked throughout the specification and the drawings with the same respective reference numerals.

FIG. 1 shows in general a covered container 100 having a container body such as a dustbin 102 that has an upright wall 104 extending upwardly from a bottom 106, defining a storage space 108 with an opening 110 on top. On the inside wall of the upright wall 104 is mounted lower half 112 of lock assembly 114, at a lock location 116 adjacent upper edge or rim 118 of the upright wall 104. A closure member such as a lid 120 is hinged onto the dustbin 102 at a hinged location 122, adjacent the rim 118 of the dustbin 102, but spaced from the lock location 116, such as opposite the lock location 116 as illustrated in FIG. 1. The lid 120 is sized for covering the opening 110 when lowered down onto the rim 118. The lock assembly 114 has an underlid half 124 that is mounted onto the underside surface 126 of the lid 120. As used herein, the direction is in reference to the normal storage position assumed by the dustbin, namely when the bottom 106 is at a position lower than the top opening 110 and the "downward" direction points from the top opening 110 to the bottom 106.

Figure 2:
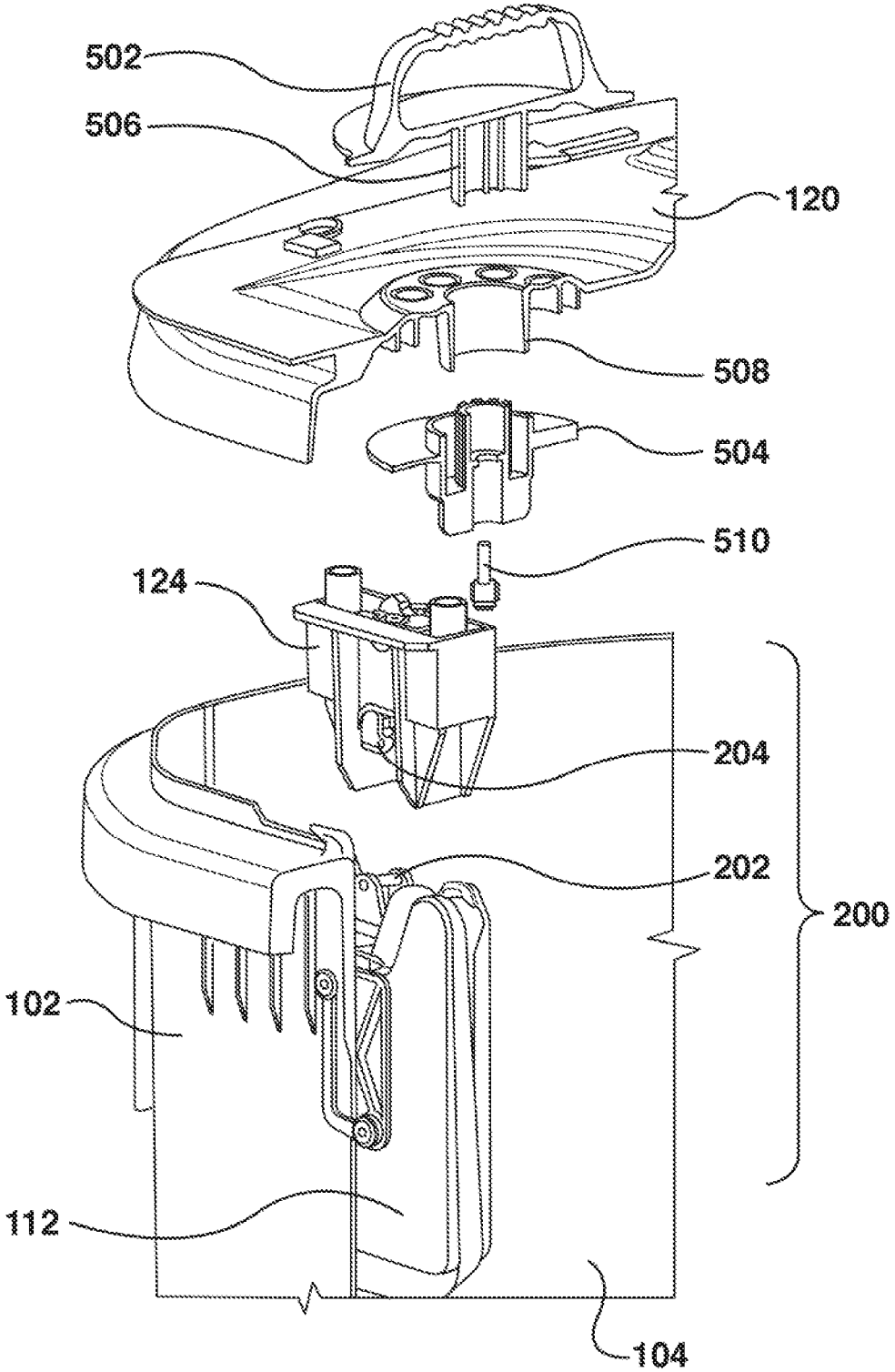
FIG. 2 illustrates in an assembly diagram the main components of the lock assembly shown in FIG. 1.
Figure 3:
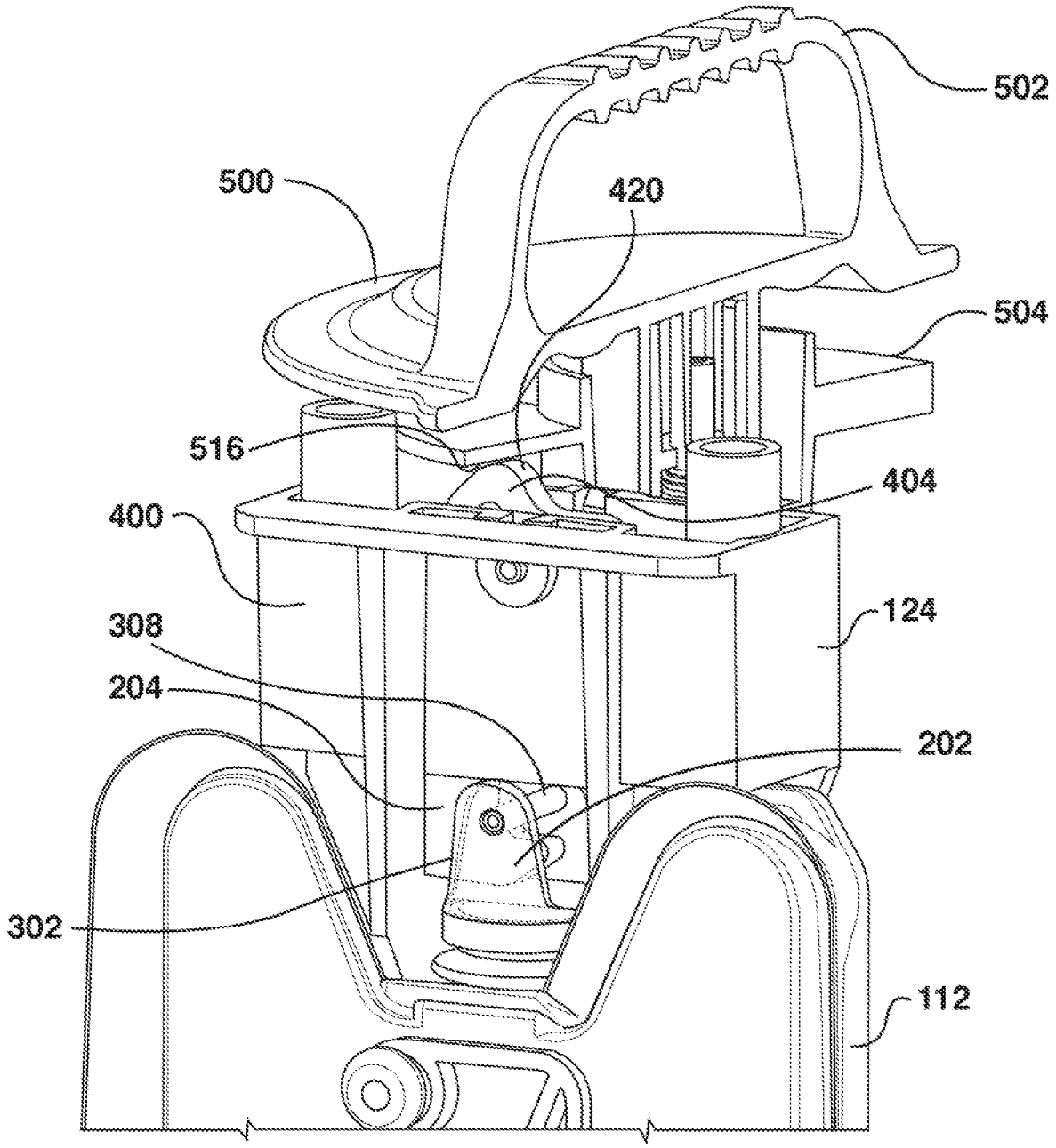
FIG. 3 is a detailed view showing the lower half and the underlid half of the lock assembly in an engaged state.
Figure 4:
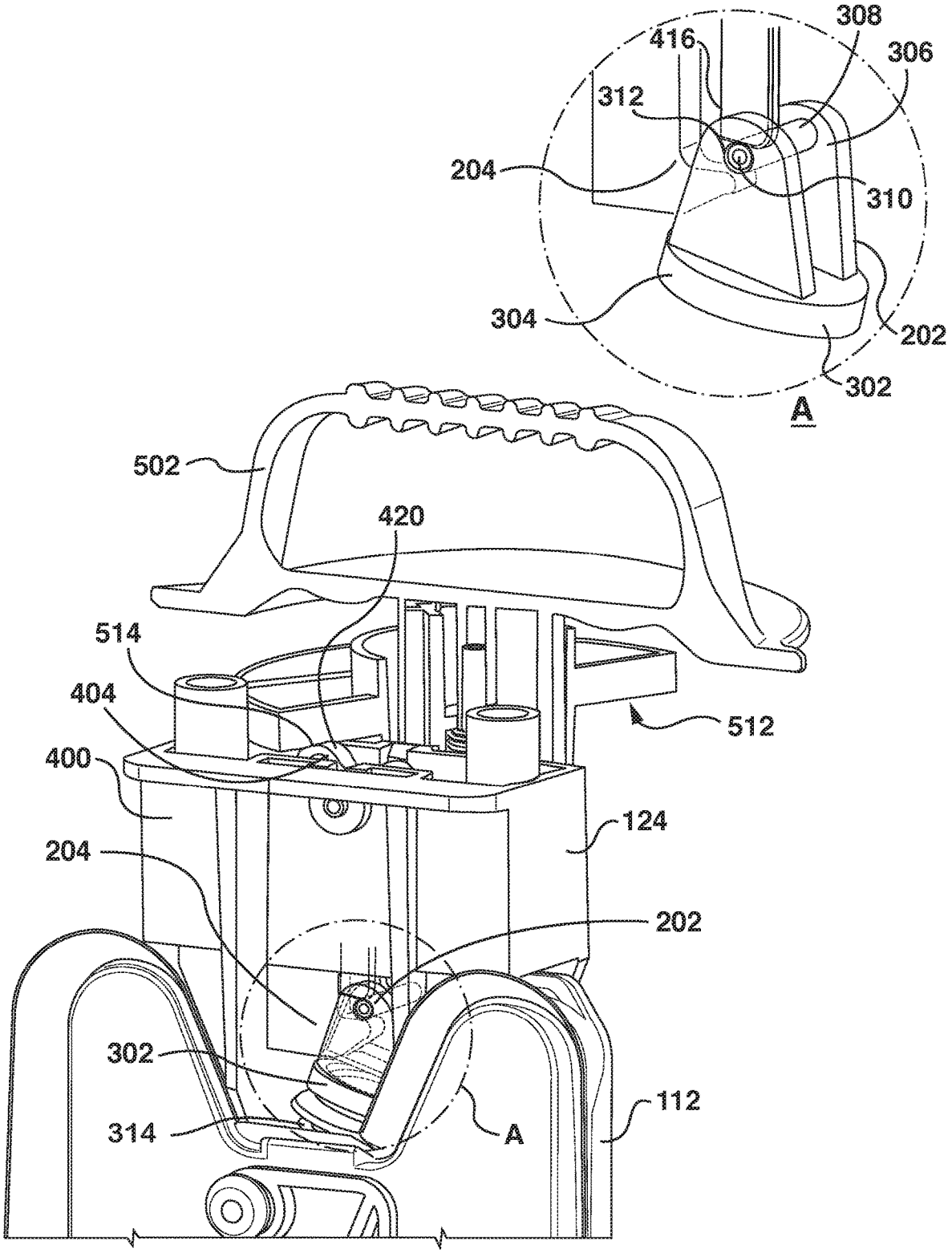
FIG. 4 is a detailed view showing the lower half and the underlid half of the lock assembly in a released state.

Referring to FIG. 2, FIG. 3 and FIG. 4, there is shown a pair of interlocking engagement members 200, each of the lower half 112 of the lock 114 and the underlid half 124 being provided with one of the interlocking engagement members 200. Each interlocking engagement member engages with the other to secure the lid 120 to the dustbin 102. The interlocking engagement members may be a strike 202 or catch provided on the lower half 112 and a hook 204 provided on the underlid half 124. In an engaged position, as is illustrated in FIG. 3, the interlocking engagement members 200, i.e., the catch 202 and the hook 204, engage with each other to prevent the underlid half 124 from being lifted from the lower half 112, thus locking the lid 120 to the dustbin 102.

FIG. 4 illustrates the lock assembly 114 in a disengaged state, in which the catch 202 is pushed away from the hook 204, so that the underlid half 124 can be lifted away from the lower half 112, without being blocked by the interlocking engagement members 200. More particularly, the hook 204 has a distal end 206 that is at a distance D from the inner edge 208 of the hook (see FIG. 5). When the catch 202 is moved, or travels, a distance longer than D away from the inner edge, the hook 204 is freely movable upwards, without being caught by the catch 202. In other words, pushing the catch 202 away from the inner edge 208 by a distance longer than D places the lock assembly, or the interlocking engagement members, in the disengaged or released state.

Reference is now made to FIG. 3 and FIG. 4. The strike or catch 202 is attached to lower half 112. The lower half 112 may include a lock casing, for attaching the lower half to the dustbin 102 and for housing or supporting other lock components, such as the strike 202, to be described in greater detail below. The strike 202 is mounted on a strike support 302 that is attached to the lock casing. As more clearly illustrated in the detailed view in FIG. 4, the strike support 302 may have a strike base 304, and two facing plates 306 extending from the base. The strike 202 may have a strike pin 308, with both ends 310 supported by the facing plates 306, for example, with each of the ends supported in each of two aligned holes 312 formed on the facing plates 306. The strike 202 (or the strike pin 308) is movable between a first position (when the strike support 302 is in an upright position as illustrated in FIG. 3), when the lock assembly 114 is in the engaged state, and a second position (when the strike support 302 is in a tilted position, i.e., when the base is tilted, as illustrated in FIG. 4) when the lock assembly 114 is in the disengaged state. Tilting the strike support 302 pushes the strike pin 308 away from its first position by a distance that is larger than distance D. Of course, as will be appreciated by those skilled in the art, although it is illustrated that the tilting of the strike support 302 pushes the strike pin 308 away from the hook's inner edge 208, any other suitable constructions can be used for pushing away the catch, to release the engagement. Further, instead of moving the catch 202 away from the hook 204, one may also construct the engagement members so that the hook 204 is movably attached to a hook assembly housing and the catch is fixedly attached to the lower half and the hook 204 is pushed away from the catch 202 to disengage the interlocking engagement members 200. A spring 314 (not seen in FIG. 3 but see FIG. 4), or any suitable biasing member, biases the catch and the hook toward each other, such as biasing the catch in the upright position, to maintain them in an engaged state.

Figure 5:
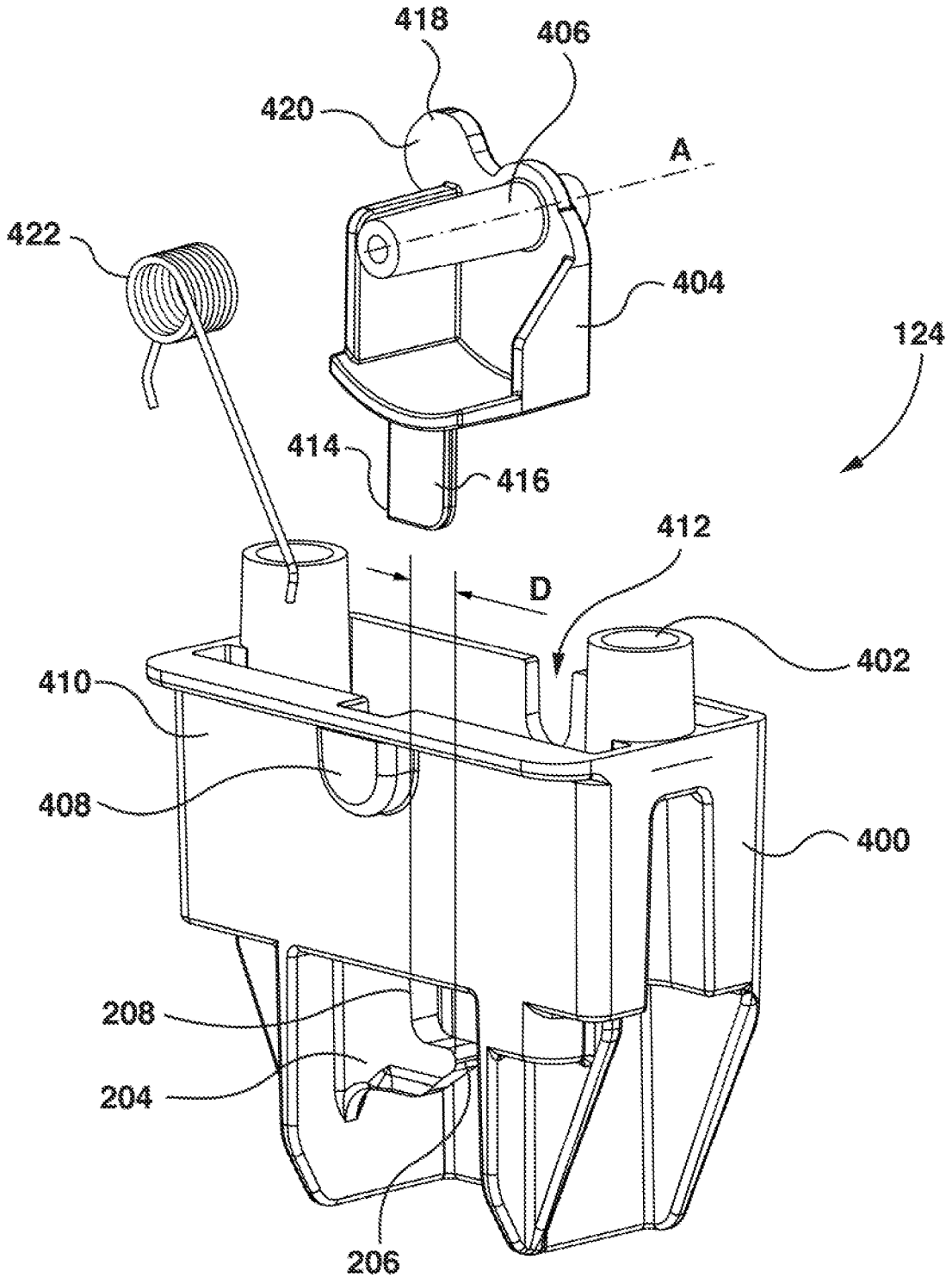
FIG. 5 shows in an assembly diagram the main components of the lower half of the lock assembly.

FIG. 5 illustrates in detail the construction of an example of an underlid half 124 that, when actuated, moves the strike 202 away to place the interlocking engagement members 200 into a disengaged or released state. The underlid half 124 shown in FIG. 5 has a hook assembly housing 400. The hook housing 400 includes suitable attachment structure, such as attachment holes 402, for screws or bolts to pass therethrough and attaching the housing securely to the underside surface 126 of the lid 120. The underlid half 124 includes a hook 204, which is integrally formed with the housing 400, though it will be appreciated that a hook 204 also may be separately formed and attached to the housing 400. A rocker 404, such as that shown in FIG. 5, is pivotally attached to the hook housing 400. This may be, for example, by way of a pivot pin 406 formed or mounted on the rocker, and supported on the housing 400. For example, the pivot pin may be supported by a pair of rocker holes 408 formed on opposing walls 410 of the housing 400, or supported by a rocker hole 408 and a matching rocker support notch 412, as shown in FIG. 5. Thus, the rocker 404 can pivot about the pivot axis A defined by the pivot pin 406.

The rocker 404 has two ends spaced from the pivot axis A. At a first end 414, namely at the end near the hook 204, is formed a release arm 416 extending from the pivot axis When the rocker 404 is pivoted about its pivot axis A, the release arm 416 moves between an extended position, at a point beyond the distal end 206 of the hook, and a retracted position, when the release arm is moved back toward the inner edge 208 and is flush with or behind the inner edge. At a second end 418 is formed a tab 420, which has a curved profile along its top edge. A spring 422, or any other suitable elastic biasing member, is provided to bias the rocker 404, and therefore the release arm 416, toward the retracted position. As the profiled top tab 420 is pushed downwards, the rocker 404 is pivoted counterclockwise in the configuration shown in FIG. 5 (in which tab is located to the left of and above the pivot axis). This in turn moves the release arm 416 toward the extended position. When the downward force is removed, the spring 422 returns the rocker 404, and therefore the release arm, to the retracted position.

Reference is now made to FIG. 3 and FIG. 4. As shown in FIG. 3, the rocker 404 is biased by the spring 422 toward the retracted position. In this position, the strike pin 308 is supported by strike support 302 and positioned above hook 204. As a result, if the lid 120 is to be lifted up, for example, by a user lifting a handle 502 attached to the lid 120, the hook 204 will be caught by the strike pin 308 at the upper edge of the hook, preventing any attempted upward travel of the hook 204, and therefore the upward travel of the housing 400 to which the hook 204 is attached, and therefore the upward travel of the lid 120 to which the housing 400 is attached. This prevents the lid from being lifted. In FIG. 4, the rocker 404 is shown to be pressed downwards, thus being pivoted counterclockwise about its pivot axis A. As a result, its release arm 416 is moved to the extended position. The release arm 416 thus pushes the strike 202 away from the hook 204. The rocker is dimensioned such that the strike is pushed by the release arm 416 by a distance that is larger than D, the length of the hook between its distal end 206 and its inner edge 208. In this extended position, the hook 204 is released from the strike pin 308 and can be lifted up without being caught by the strike pin 308. In other words, when the rocker 404 is pivoted to this extended position, the interlocking members, in this case the hook 204 and the strike 202, is placed in a disengaged or released state, too.

An actuator 500 is conveniently provided to assist a user in his or her pushing down the tab 420 of the rocker 404 and lifting the lid. For example, the actuator 500 may comprise a handle 502 with a control disk 504 attached thereto, as illustrated in the figures. Reference is made to FIG. 2. The handle 502 is rotatably attached to the lid 120. For example, the handle 502 may have a cylindrical stub tube 506 that is fitted inside a handle hole 508 formed on the lid 120. Sufficient clearance is provided between the stub tube 506 and the handle hole 508 so that the cylindrical stub tube 506 can rotate freely within the handle hole 508. The control disk 504 is fixedly attached to the handle 502, for example, by a screw or bolt 510, so that as the handle 502 is turned by an angle, the control disk 504 is turned together with the handle by the same angle. Reference is now made to FIG. 3 and FIG. 4. Undersurface 512 of control disk 504, i.e., the surface facing the top tab 420 of rocker 404, is sloped, or at least has a first angular location 514 (see FIG. 4) that is lower, when installed, than a second angular location 516 (see FIG. 3). The first and second angular locations are separated by a non-zero angle. These two angular locations may be smoothly joined by the undersurface 512. The control disk is positioned such that when the control disk 504 is turned and aligns the first angular location 514 with the top tab 420, the undersurface 512 will press down the top tab 420 to disengage the hook 204 from the strike pin 308 (as shown in FIG. 4), and when the control disk 504 is turned and aligns the second angular location 516 with the top tab 420, there will be a gap between the undersurface 512 and the tab 420, or at least the undersurface 512 does not press the tab 420 sufficiently downward to disengage the hook 204 from the strike pin 308 (as shown in FIG. 3). Thus, by turning the handle 502, the actuator 500 can pivot the rocker 404 to disengage the interlocking engagement members, namely the hook 204 and the strike 202 in this example. Lifting the handle 502 will then lift the lid 120. On the other hand, when the lid 120 is lowered to cover the opening 110, the curved lower edge of the hook will push the strike pin 308 away against the biasing force until the distal end 206 of the hook passes the strike pin 308, to bring the upper edge of the hook past the strike pin. The restoring force of the biasing member will urge the strike to return to its upright position. Turning the handle 502 to align the second angular location of the control disk 504 with the tab will remove the downward force from the tab 420 of the rocker 404, thus allowing spring 422 to pivot the rocker 404 back to the retracted position. This returns the interlocking engagement members to the engaged state, and secures the lid 120 to the container or dustbin 102.

Figure 6:
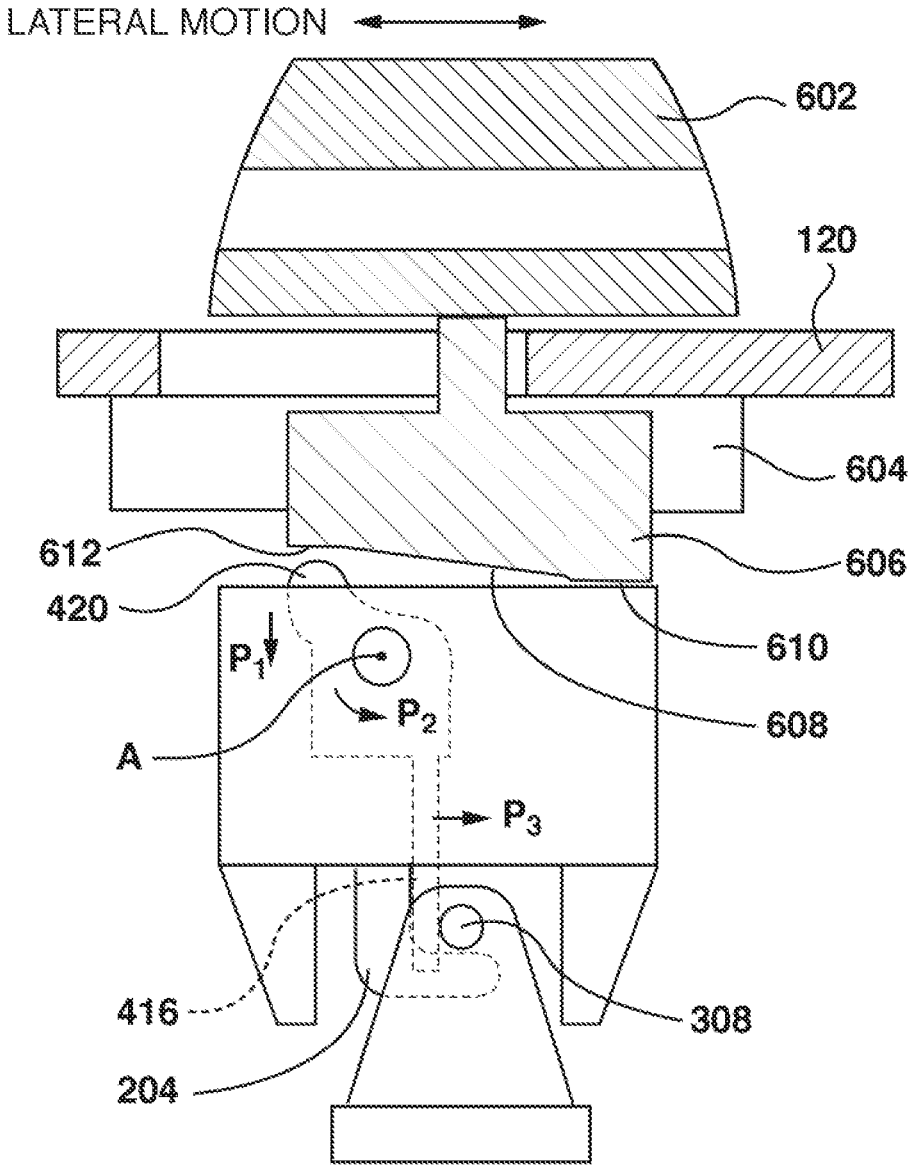
FIG. 6 shows another example of an actuator for releasing the lock and lifting the lid.

As will be appreciated by those skilled in the art, the handle does not need to be rotatable and the actuator may be constructed in any other suitable manner for assisting a user in exerting a downward pressure. FIG. 6 illustrates such an alternative. A slider handle 602 is mounted to the lid 120 and slidable along a track 604 attached to the lid. The slider handle 602 has an actuation block 606 that has a sloped undersurface 608. Thus, at a first block location 610, the sloped undersurface 608 is lower than at a second block location 612. When the slider handle 602 is slid and aligns the first block location 610 with the top tab 420, the sloped undersurface 608, cooperating with the curved upper edge of the top tab, presses down the tab 420 (along direction P1) to pivot it counterclockwise (along direction P2), to move the release arm 416 to the extended position (along direction P3), and thus pushes the strike pin 308 away from the hook 204, to disengage the interlocking engagement members 200. When the slider handle 602 is slid and aligns the second block location 612 with the top tab 420, a gap is left between the sloped undersurface 608 and the top tab, or at least the top tap is not pressed sufficiently down to disengage the hook 204 from the strike pin 308. Of course, instead of constructing a handle that is slidable, one may also simply provide a handle that can be pressed downwards, thus exerting a downward pressure on the tab 420 to disengage the interlocking engagement members 200, namely the hook 204 and the strike pin 308, and provide another pull-up tab nearby for lifting the lid.

Other variations also may be made to the examples described. For example, the tab 420 does not have to have a curved profile. A slopped tab top may also cooperate with a slopped undersurface 512 to provide the same result. As a further variation, the top of the tab even may be flat or any other shape, provided that the undersurface of the control disk or the actuation block is appropriately shaped so that the turning or sliding of the handle will convert the lateral turning or sliding motion to a downward force to press down the tab 420, to move it from the engaged position to the disengaged position. Of course, when the handle is constructed for a user to press down directly the tab 420, the tab top may have any shape.

Various embodiments of the invention have now been described in detail. Those skilled in the art will appreciate that numerous modifications, adaptations and variations may be made to the embodiments without departing from the scope of the invention, which is defined by the appended claims. The scope of the claims should be given the broadest interpretation consistent with the description as a whole and not to be limited to these embodiments set forth in the examples or detailed description thereof.

What is claimed is:

1. A lock for a container lid sized to cover a top opening of a container, the lock comprising:

a lock casing for attaching to the container, a pair of interlocking engagement members, the first interlocking engagement member of the pair being supported on the lock casing, and the second interlocking engagement member of the pair for attaching to the container lid;

a first biasing member urging the pair of interlocking engagement members to engage with each other to keep the container lid in a closed position, covering the top opening, a rocker pivotally attached to the second interlocking engagement member at a pivot point, the rocker having a top tab extending upwardly and a release arm extending downwardly, both from the pivot point, wherein pressing down of the top tab moves the release arm to disengage the pair of interlocking engagement members from each other so that the container lid can be lifted to uncover the top opening, and an actuator having an undersurface for disposition above the top tab and under the container lid, the top tab having a curved top edge for contacting with the undersurface which converts a lateral motion of the actuator to a downward pressure on the top tab to press down the top tab.

2. The lock of claim 1, wherein the first interlocking engagement member is a strike, and the second interlocking engagement member is a hook assembly, the hook assembly having a hook for engagement by the strike when the strike is in an engaged position and for disengagement from the strike when the strike is in a disengaged position.

3. The lock of claim 2, wherein said strike has facing support plates formed on a base, and a strike pin supported at either end thereof by the facing support plates, the hook engages with the strike pin when the strike is in the engaged position, and tilting the base moves the strike, and thereby the strike pin, towards the disengaged position, and the hook has an upper edge for engaging the strike pin when the strike is in the engaged position and a curved lower edge that pushes the strike pin to tilt the base against the urging of the first biasing member to disengage the strike from the hook until the upper edge moves past the strike pin.

4. The lock of claim 3, further comprising a handle for rotatable mounting to the container lid, and wherein the lateral motion of the actuator is a lateral turning motion, and the actuator comprises a control disk fixedly attached to the handle for turning together with the handle, the control disk has a first angular location and a second angular location spaced at a non-zero angle from the first angular location, wherein when the handle is turned to align the first angular location with the top tab, the control disk makes contact with and presses down the top tab to disengage the strike from the hook, and when the handle is turned to align the second angular location with the top tab, the control disk makes no contact with the top tab or does not press the top tab down sufficiently to disengage the strike from the hook, thus leaving the strike in the engaged position.

5. The lock of claim 4, wherein the undersurface is formed on the control disk and transitions continuously from the first angular location to the second angular location.

6. The lock of claim 3, further comprising a handle for slidable mounting to the container lid, and wherein the lateral motion of the actuator is a lateral sliding motion, and the actuator comprises an actuation block fixedly attached to the handle for sliding together with the handle, the undersurface being formed on the actuation block, the actuation block has a first block position and a second block position spaced at a non-zero distance from the first block position, wherein when the handle is slid to align the first block position with the top tab, the undersurface contacts and presses down the top tab to disengage the strike from the hook, and when the handle is slid to align the second block position with the top tab, the undersurface makes no contact with the top tab or does not press the top tab down sufficiently to disengage the hook from the strike, thus leaving the strike in the engaged position.

7. The lock of claim 3, further comprising a second biasing member, wherein the release arm is movable between an extended position, at which position, the release arm pushes the strike to disengage the strike from the hook, and a retracted position, at which position, the release arm does not disengage the strike from the hook.

8. The lock of claim 7, wherein the hook is fixedly located on the hook assembly, and the release arm pushes the strike away from the hook against the urging of the first biasing member to disengage the strike from the hook when the top tab is pressed down.

9. The lock of claim 8, wherein the hook is integrally formed with the hook assembly.

10. The lock of claim 8, wherein the second biasing member urges the release arm away from the strike, and wherein the release arm pushes the strike away from the hook assembly against the urging of the first biasing member and the second biasing member to disengage the strike from the hook when the top tab is pressed down.

11. A covered container comprising:

a container body having a top opening for receiving objects therein, a lid joined to the container body at a hinged location adjacent the top opening, and a lock comprising:

a lock casing for attachment to the container, a pair of interlocking engagement members, the first interlocking engagement member of the pair being supported on the lock casing, and the second interlocking engagement member of the pair being attached to the lid, a first biasing member urging the pair of interlocking engagement members to engage with each other to keep the lid in a closed position, covering the top opening, a rocker pivotally attached to the second interlocking engagement member at a pivot point, the rocker having a top tab extending upwardly and a release arm extending downwardly, both from the pivot point, wherein pressing down of the top tab moves the release arm to disengage the pair of interlocking engagement members from each other so that the lid can be lifted to uncover the top opening, and an actuator for a user to press down the top tab and to lift the lid to uncover the top opening, wherein the lock casing is attached to the container at a latch location adjacent the top opening spaced from the hinged location, the hook assembly is attached to the lid at a location so that the pair of interlocking engagement members engage with each other to secure the lid in the closed position, and the actuator of the lock is attached to the lid and disposed above the top tab when the lid is in the closed position so that an undersurface of the actuator contacts and presses down the top tab, the top tab having a curved top edge which converts a lateral motion of the actuator to a downward pressure on the top tab to press down the top tab, when the user moves the actuator from outside the lid.

12. The lock of claim 11, wherein the first interlocking engagement member is a strike, and the second interlocking engagement member is a hook assembly, the hook assembly having a hook for engagement by the strike when the strike is in an engaged position and for disengagement from the strike when the strike is in a disengaged position.

13. The covered container of claim 12, wherein said strike has facing support plates formed on a base, and a strike pin supported at either end thereof by the facing support plates, the hook engages with the strike pin when the strike is in the engaged position, and tilting the base moves the strike, and thereby the strike pin, towards the disengaged position, and wherein the hook has an upper edge for engaging the strike pin when the strike is in the engaged position and a curved lower edge that pushes the strike pin to tilt the base against the urging of the first biasing member to disengage the strike from the hook until the upper edge moves past the strike pin.

14. The covered container of claim 13, further comprising a handle for rotatable mounting to the container lid, and wherein the lateral motion of the actuator is a lateral turning motion, and the actuator comprises a control disk fixedly attached to the handle for turning together with the handle, the undersurface being formed on the control disk, the control disk has a first angular location and a second angular location spaced at a non-zero angle from the first angular location, wherein when the handle is turned to align the first angular location with the top tab, the undersurface of the control disk makes contact with and presses down the top tab to disengage the strike from the hook, and when the handle is turned to align the second angular location with the top tab, the undersurface makes no contact with the top tab or does not press the top tab down sufficiently to disengage the strike from the hook, thus leaving the strike in the engaged position.

15. The covered container of claim 14, wherein the undersurface is formed on the control disk and transitions continuously from the first angular location to the second angular location.

16. The covered container of claim 13, further comprising a handle for slidable mounting to the container lid, and wherein the lateral motion of the actuator is a lateral sliding motion, and the actuator comprises an actuation block fixedly attached to the handle for sliding together with the handle, the undersurface being formed on the actuation block, the actuation block has a first block position and a second block position spaced at a non-zero distance from the first block position, wherein when the handle is slid to align the first block position with the top tab, the undersurface of the actuation block contacts with and presses down the top tab to disengage the strike from the hook, and when the handle is slid to align the second block position with the top tab, the undersurface makes no contact with the top tab or does not press the top tab down sufficiently to disengage the strike from the hook, thus leaving the strike in the engaged position.

17. The covered container of claim 13, further comprising a second biasing member, wherein the release arm is movable between an extended position, at which position, the release arm pushes the strike to disengage the strike from the hook, and a retracted position, at which position, the release arm does not disengage the strike from the hook.

18. The covered container of claim 17, wherein the hook is fixedly located on the hook assembly, and the release arm pushes the strike away from the hook against the urging of the first biasing member to disengage the strike from the hook when the top tab is pressed down.

* * * * *